United States Patent [19]

Mosley

[11] Patent Number: 4,558,791

[45] Date of Patent: Dec. 17, 1985

[54] FURNACE DELINING APPARATUS

[75] Inventor: David R. Mosley, Newton Abbot, England

[73] Assignee: M.D.S. Furnace Services Limited, Newton Abbot, England

[21] Appl. No.: 569,755

[22] Filed: Jan. 10, 1984

[30] Foreign Application Priority Data

Jan. 26, 1983 [GB] United Kingdom ..... 8302170

[51] Int. Cl.[4] ..... E21B 15/04

[52] U.S. Cl. ..... 212/266; 15/104.1 C; 173/39; 403/103

[58] Field of Search ..... 212/266, 175, 177; 173/37, 39, 40, 41, 42, 43, 44; 15/104.1 C; 403/84, 93, 96, 97, 103; 52/117

[56] References Cited

U.S. PATENT DOCUMENTS

| | | | |
|---|---|---|---|
| 3,020,012 | 2/1962 | Moracco et al. | 173/43 |
| 3,346,300 | 8/1966 | Grant | 299/70 |
| 3,354,967 | 10/1965 | Skendrovic | 173/43 |
| 4,314,622 | 3/1980 | Lindquist | 182/2 |

FOREIGN PATENT DOCUMENTS

| | | |
|---|---|---|
| 1558561 | 1/1967 | Fed. Rep. of Germany . |
| 3149411 | 12/1981 | Fed. Rep. of Germany . |
| 1387563 | 12/1970 | United Kingdom . |
| 1387562 | 12/1970 | United Kingdom . |

*Primary Examiner*—Trygve M. Blix
*Assistant Examiner*—Thomas J. Brahan
*Attorney, Agent, or Firm*—Woodcock Washburn Kurtz Mackiewicz & Norris

[57] ABSTRACT

A furnace delining apparatus has a telescopic jib mounted about a horizontal pivot axis on a turntable. The distal end of the jib carries a tool on a carrier swingable about an axis transverse to the jib axis. The carrier is pivotally mounted on a jib extension which can be rotated about its longitudinal axis to selected positions which are defined by locating means on the jib. The extension is permanently mounted for rotation on a spigot projecting axially from the jib and is axially slidable between a position in engagement with the locating means and a free position in which it can be rotated to a new angular position.

7 Claims, 5 Drawing Figures

FURNACE DELINING APPARATUS

Figure 1:
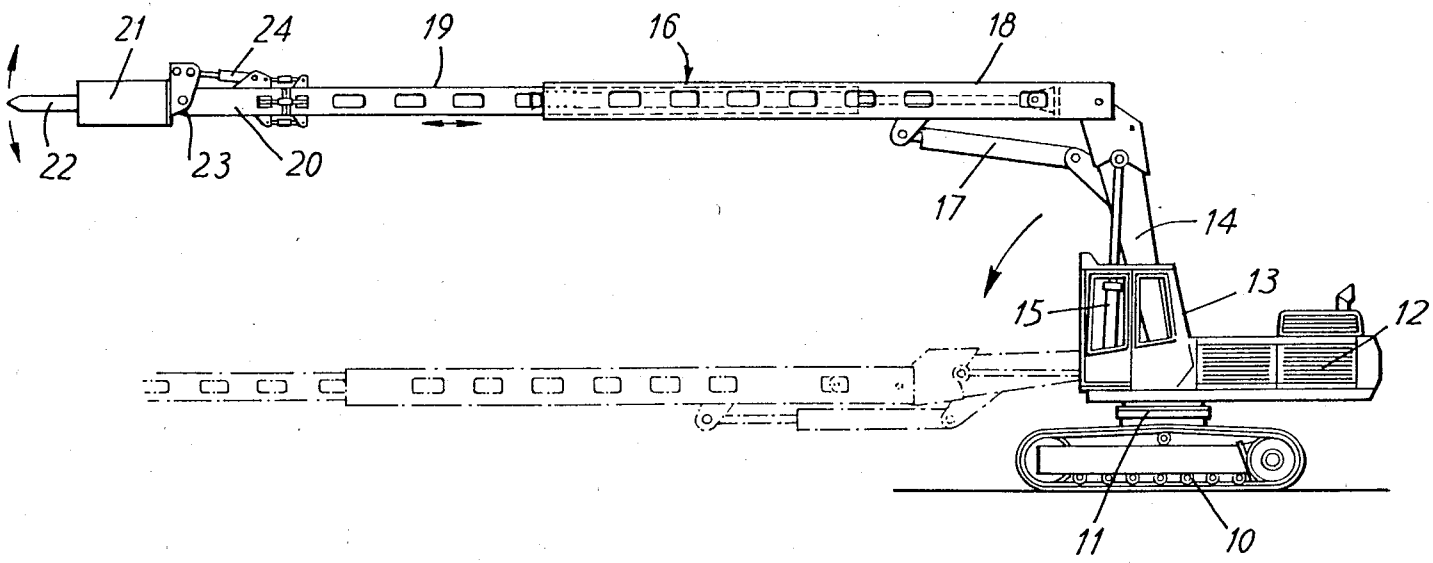

The present invention relates to furnace delining apparatus.

One form of apparatus for this purpose is described in U.K. Patent Specification No. 1,387,562. A power-actuated tool in the form of a pneumatic hammer is mounted on the end of a telescopic jib which is pivotally connected to a boom which in turn is pivotally connected to a turntable mounted on a fixed or travelling platform. The boom and jib are movable in a vertical plane by means of hydraulic rams and thus the tool can be introduced into a furnace or other receptacle and placed as required in that plane. The tool serves for removing worn refractory linings and/or slag from furnaces, especially metallurgical furnaces, and from vessels, ladles and the like used in conjunction with such furnaces.

The delining apparatus has to be capable of withstanding conditions in the furnace while the linings are still hot because it is important to carry out the delining operation as rapidly as possible in order to enable the furnace to be brought back into service with the minimum delay. This has become even more important with the increasing size of furnaces. This increase in size also increases the difficulties of access to the interior from a working position outside the furnace. In addition to increased reach there is a demand for greater flexibility to enable the tool to reach all parts of the lining while maintaining a suitable angle of attack with respect to the lining surface.

In accordance with the present invention there is provided a furnace delining apparatus comprising a turntable mounted for rotation about a vertical axis, a telescopic jib pivotally connected to the turntable for movement of the jib in a vertical plane, and a tool mounted at the outer end of the telescopic jib, wherein the jib consists of a first part pivotally connected with the turntable, a second part telescopically mounted on the first part, and a third part forming an extension of the second part and coupled thereto by a spigot on one part engaging a bearing socket on the other part to allow rotation of the third part about the axis of the jib, the third part being further coupled to the second part by releasable fastening devices which when disengaged allow relative movement of the second and third parts along the said axis with the spigot remaining within the bearing socket, and locating means are provided which when the fastening devices are re-engaged locate the third part in one of a number of angular positions relative to the second part which can be selected by rotation of the third part.

In the preferred construction the parts of the jib are of square cross-section and the third part can be fastened in any one of four positions at right angles to each other relative to the second part. Thus the tool may project from any one of the four faces of the jib. Preferably the tool is swingably mounted on one face of the third part of the jib and is adjustable in angular position by a pneumatic or hydraulic cylinder extending between the tool and the said face of the third part.

Preferably the jib is pivotally mounted on a boom which in turn is pivotally mounted on the turntable, the two pivots allowing movement in the same vertical plane and in particular enabling the jib to be disposed horizontally at different heights above the turntable. The movements of the boom and the jib in the vertical plane may be separately controlled by hydraulic rams connected between the turntable and the boom and between the boom and the jib. The telescopic action of the jib may be effected by a ram mounted within the jib and connecting the first and second parts.

Figure 2:
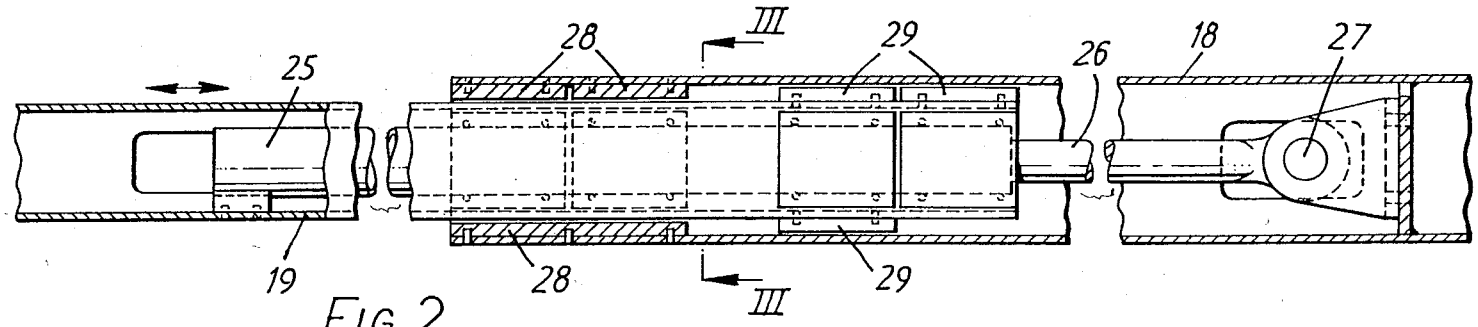
Figure 3:
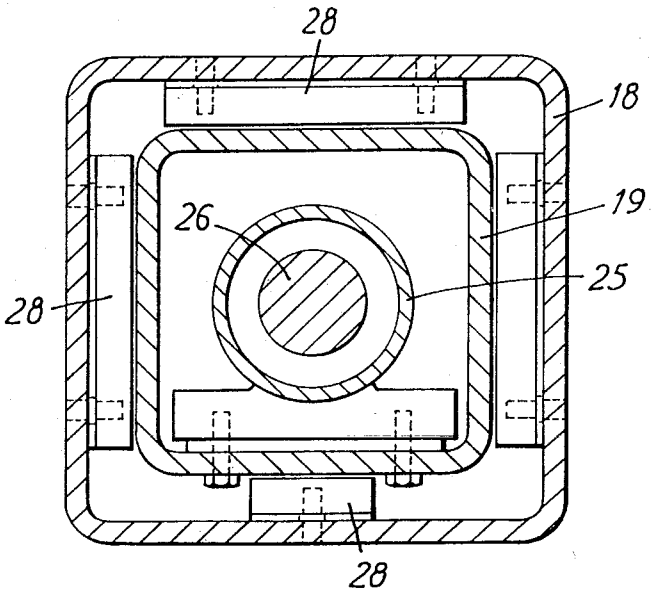
Figure 4:
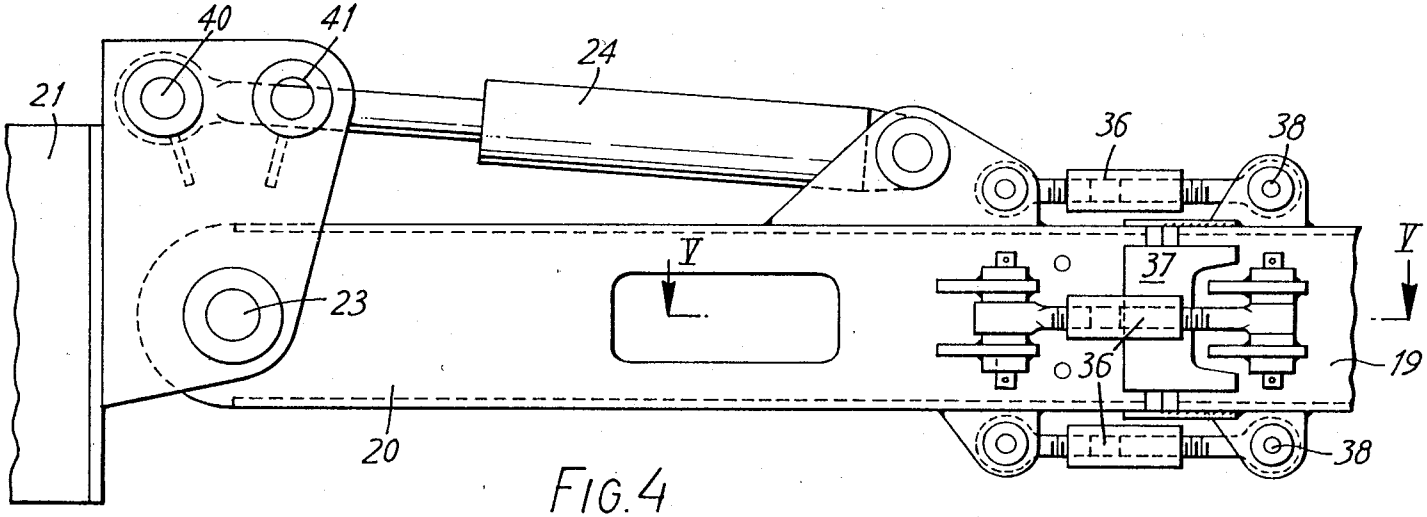
Figure 5:
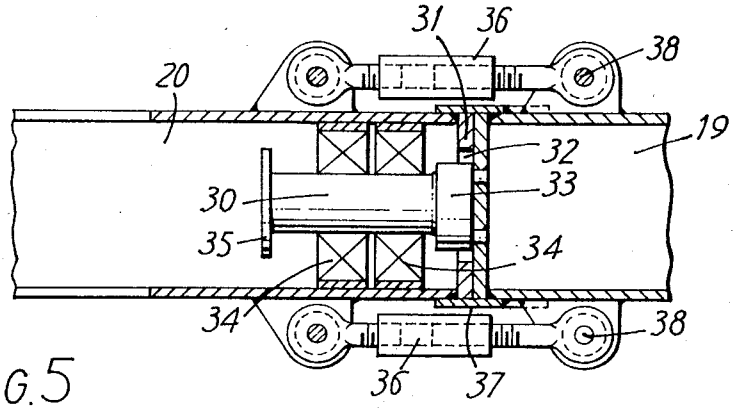

The invention will be described in more detail with the aid of an example illustrated in the accompanying drawings, in which:

FIG. 1 is a side elevation of a furnace delining apparatus in accordance with the invention showing in broken lines an alternative position of the boom and jib, FIG. 2 is a side view of the main body of the telescopic jib in partial section, FIG. 3 is a section on the line III—III of FIG. 2, FIG. 4 is a side elevation of the end part of the jib showing the tool mounting, and FIG. 5 is a section on the line V—V in FIG. 4.

The apparatus shown is based on the chassis of a commercially available tracked trenching machine sold under the registered trade mark "Hymac". This has continuous tracks 10 for travelling over the ground and a turntable 11 which supports the power unit 12 and driver's cab 13. A boom 14 is pivotally mounted on the turntable 11 and is swingable in a vertical plane by means of a hydraulic ram 15. In the trenching machine an arm pivotally attached to the end of the boom 14 carries an excavator bucket and is movable in the same vertical plane as the boom by means of a further hydraulic ram. In the delining apparatus this excavator arm is replaced by a telescopic jib 16 which is pivotally connected to the boom 14 and is adjustable in position by means of a ram 17 connected between the boom and the jib. By controlling the rams 15 and 17 it is possible to move the jib between upper and lower horizontal positions shown in full and broken lines in FIG. 1.

The jib 16 consists of an outer tube 18 pivotally attached to the boom 14 and an inner tube 19 slidable within the tube 18. At the free end of the inner tube 19 is an extension piece 20 and on the extension piece 20 is mounted a pneumatic hammer 21 with a bit 22. The hammer 21 is adjustable in angular position about a pivot 23 by a ram 24 as shown by the arrows.

FIGS. 2 and 3 show details of the bearing and driving arrangements for effecting movement of the inner tube 19 within the outer tube 18 of the telescopic jib. The two tubes, both of square cross-section, are interconnected by a ram whose cylinder 25 is mounted within the inner tube 19 and whose piston rod 26 is coupled at 27 to the inner end of the outer tube 18. The weight of the piston rod 26 is greater than that of the oil-filled cylinder 25 and it is desirable to keep this weight closer to the chassis of the machine.

The forward end of the outer tube 18 has attached to its inner surface on three faces a pair of bearing pads 28 composed of a wear-resistant synthetic resin material. On the lower face a single narrow elongated bearing pad 28 is provided. The pads 28 provide a sliding bearing for the inner tube 18 which, at its inner end, has a similar set of bearing pads 29 attached to its four outer faces. In addition to facilitating the telescopic movement of the jib, the bearing pads 28 and 29 limit the relative movement of the two tubes forming the jib as they approach the fully-extended position. As can be seen in FIG. 2, when the inner tube 19 is driven by the ram 25, 26 towards its extended position, the pads 29 will engage the ends of the pads 29 to prevent the inner tube 19 escaping from the outer tube 18.

As shown in FIG. 5 the extension piece 20 is mounted on a spigot 30 which projects from the end of the inner tube 19 in alignment with the axis of the jib. The end of the extension piece 20, which is a square tube similar to the inner tube 19, carries an end plate 31 with an aperture 32 which fits with some clearance around a boss 33 at the base of the spigot 30. Bearings 34 mounted in the inside of the extension tube 20 and consisting of blocks with apertures to fit over the spigot 30 allow the extension tube 20 to rotate with respect to the inner tube 19. A retaining plate 35 screwed to the end of the spigot 30 prevents separation of the extension tube 20 from the inner tube 19 while allowing some axial movement. The extension tube 20 and the inner tube 19 can be held tightly together by four turnbuckles 36 mounted on the four faces of the tubes. Plates 37 welded to the faces of the tube 19 locate the extension tube 20 in the required angular position about the spigot 30. When it is desired to turn the tube 20 through 90° in either direction, or through 180°, the turnbuckles 36 are loosened and are released by knocking out pins 38 by which they are coupled to the tube 19. The extension tube 20 can then be drawn forward on the spigot 30, free of the plates 37, and turned to the new position before the turnbuckles are re-connected and tightened.

The ram 24 which controls the angular position of the pneumatic hammer 21 has two alternative coupling points 40 and 41 to give the maximum range of adjustment.

What is claimed is:

1. A furnace delining apparatus comprising a turntable mounted for rotation about a vertical axis, a telescopic jib pivotally connected to the turntable for movement of the jib in a vertical plane, and a tool mounted at the outer end of the telescopic jib, wherein the jib consists of a first part pivotally connected with the turntable, a second part telescopically mounted on the first part, and a third part forming an extension of the second part and coupled thereto for rotation of said third part about the axis of the jib, said coupling comprising a bearing socket on one part and spigot on the other part engaging said socket, releasable fastening devices connecting said third part to said second part, release of said fastening devices allowing relative movement of said second and third parts along said axis with the spigot remaining within the bearing socket, and locating means which when the fastening devices are re-engaged locate said third part in an angular position about said axis selected by said rotation about said axis.

2. Furnace delining apparatus as claimed in claim 1 wherein said parts of the jib are of square cross-section whereby said third part can be located in any of four angular positions at right angles to each other.

3. Furnace delining apparatus as claimed in claim 2 in which the tool is swingably mounted on the third part of the jib.

4. Furnace delining apparatus as claimed in claim 3 in which the tool is swingably mounted on one face of said third part and is coupled by a fluid-pressure cylinder to the said one face whereby it may be adjusted in position about an axis transverse to the jib.

5. Furnace delining apparatus as claimed in claim 1 comprising a boom pivotally mounted on the turntable about a generally horizontal pivot axis, said jib being pivotally mounted on said boom about a generally parallel axis, and hydraulic rams connected between the turntable and the boom and between the boom and the jib.

6. Furnace delining apparatus as claimed in claim 1 comprising a ram mounted within the jib and coupling said first and second parts for telescopic movement.

7. Furnace delining apparatus as claimed in claim 6 in which the cylinder of said ram is fixed within said second part of the jib.

* * * * *